US008814379B2

(12) United States Patent
Griffiths et al.

(10) Patent No.: US 8,814,379 B2
(45) Date of Patent: Aug. 26, 2014

(54) CONTAINER ILLUMINATION DEVICE

(75) Inventors: Bryn Griffiths, Richmond (GB); Jon Duncan, Middlesex (GB)

(73) Assignee: Benmore Ventures Ltd. (VG)

( * ) Notice: Subject to any disclaimer, the term of this patent is extended or adjusted under 35 U.S.C. 154(b) by 445 days.

(21) Appl. No.: 13/061,597

(22) PCT Filed: Sep. 1, 2009

(86) PCT No.: PCT/GB2009/002097
§ 371 (c)(1),
(2), (4) Date: Apr. 7, 2011

(87) PCT Pub. No.: WO2011/007113
PCT Pub. Date: Jan. 20, 2011

(65) Prior Publication Data

US 2011/0188237 A1 Aug. 4, 2011

(30) Foreign Application Priority Data

Sep. 1, 2008 (GB) ..... 0815897.4

(51) Int. Cl.

| | |
|---|---|
| ***F21L 4/00*** | (2006.01) |
| ***H04M 1/22*** | (2006.01) |
| ***F21V 33/00*** | (2006.01) |
| ***B65D 23/12*** | (2006.01) |
| ***B65D 25/20*** | (2006.01) |

(52) U.S. Cl.
CPC ..... *B65D 23/12* (2013.01); *B65D 2203/12* (2013.01); *B65D 25/205* (2013.01)
USPC ..... 362/191; 362/101

(58) Field of Classification Search
USPC ..... 362/191, 101, 96
See application file for complete search history.

(56) References Cited

U.S. PATENT DOCUMENTS

| | | | | |
|---|---|---|---|---|
| 5,339,548 | A | 8/1994 | Russell | |
| 5,464,092 | A | 11/1995 | Seeley | |
| 5,784,265 | A | 7/1998 | Chen | |
| 5,785,407 | A | 7/1998 | Ratcliffe et al. | |
| 6,005,204 | A * | 12/1999 | Choi et al. | 200/52 R |

(Continued)

FOREIGN PATENT DOCUMENTS

| | | |
|---|---|---|
| DE | 296 13 520 U1 | 10/1996 |
| DE | 198 52 527 A | 5/2000 |

(Continued)

OTHER PUBLICATIONS

U.S. Appl. No. 29/327,032, Griffiths et al., Not Yet Published.

*Primary Examiner* — Ismael Negron
*Assistant Examiner* — William N Harris
(74) *Attorney, Agent, or Firm* — Craig A. Fieschko, Esq.; DeWitt Ross & Stevens S.C.

(57) ABSTRACT

A self-contained illumination device (10) for attachment to a container, e.g. to the base of a bottle, comprises a printed circuit board (12), with LEDs (14) attached to the central region of a liquid-impervious flexible pad (11). The central region is surrounded by an annular adhesive region which is arranged to attach the pad to the container in liquid-tight manner. The pad comprises a base layer (32) of plasticized paper or PVC, covered by an adhesive layer (34) and, before attachment to the container, a peripheral layer (36) of a release paper.

19 Claims, 8 Drawing Sheets

(56) References Cited

U.S. PATENT DOCUMENTS

| | | | | |
|---|---|---|---|---|
| 6,010,742 | A | 1/2000 | Tanabe et al. | |
| 6,082,866 | A * | 7/2000 | Amedee | 362/34 |
| 6,163,248 | A | 12/2000 | Paek et al. | |
| 6,254,247 | B1 | 7/2001 | Carson | |
| 6,271,753 | B1 | 8/2001 | Shukla | |
| 6,419,384 | B1 | 7/2002 | Lewis et al. | |
| 6,420,008 | B1 | 7/2002 | Lewis et al. | |
| 6,796,670 | B2 * | 9/2004 | Winters et al. | 362/34 |
| 6,831,552 | B2 | 12/2004 | Lin | |
| 7,674,001 | B1 * | 3/2010 | Ferrin et al. | 362/101 |
| 7,687,734 | B2 * | 3/2010 | Weber | 200/406 |
| 2002/0183883 | A1 | 12/2002 | Carr et al. | |
| 2003/0081408 | A1 | 5/2003 | Tai | |
| 2003/0095253 | A1 | 5/2003 | Chow | |
| 2004/0004829 | A1 | 1/2004 | Policappelli | |
| 2004/0017678 | A1 | 1/2004 | Liu | |
| 2004/0042201 | A1 | 3/2004 | Lee | |
| 2004/0136177 | A1 * | 7/2004 | Lewis et al. | 362/101 |
| 2004/0212987 | A1 | 10/2004 | Lu | |
| 2005/0024858 | A1 | 2/2005 | Johnson | |
| 2005/0207141 | A1 * | 9/2005 | Boesch et al. | 362/101 |
| 2006/0139928 | A1 | 6/2006 | Griffiths et al. | |
| 2008/0273319 | A1 * | 11/2008 | VanderSchuit | 362/101 |

FOREIGN PATENT DOCUMENTS

| | | | |
|---|---|---|---|
| DE | 102 04 153 | A | 8/2003 |
| DE | 203 12 336 | U1 | 2/2004 |
| DE | 20 2007 01373 | U1 | 2/2008 |
| EC | 001000087-0001 | | 8/2008 |
| EP | 0 757 012 | A | 2/1997 |
| EP | 1 155 972 | A | 11/2001 |
| EP | 1 939 102 | A1 | 7/2008 |
| ES | 2 147 473 | A1 | 9/2000 |
| FR | 2 769 596 | A | 4/1999 |
| FR | 2 827 839 | A3 | 1/2003 |
| GB | 2 282 366 | A | 4/1995 |
| GB | 2 393 954 | A | 4/2004 |
| RU | 2 164 888 | C1 | 4/2001 |
| RU | 2 186 013 | C2 | 7/2002 |
| WO | WO 00/55743 | A | 9/2000 |
| WO | WO 01/89950 | A | 11/2001 |
| WO | WO 02/099783 | A | 12/2002 |
| WO | WO 03/013959 | A2 | 2/2003 |
| WO | WO 2004/110892 | A1 | 12/2004 |
| WO | WO 2007/095569 | A2 | 8/2007 |

* cited by examiner

CONTAINER ILLUMINATION DEVICE

FIELD OF THE INVENTION

The present invention relates to a self-contained illumination device for illuminating the contents of beverage bottles and other container types that does not necessitate any modifications to the bottle/container. This provides a powerful new marketing and promotional tool for the beverage industry. Such a device is disclosed in international patent application WO2004/110892.

BACKGROUND OF THE INVENTION

Over the years beverage companies have invested large sums to build plant and machinery to produce a virtual global standard in beverage bottles. In the USA, beer bottles for example come in 12 oz sizes, whereas in the rest of world beer bottles are 33 cl. They are all substantially the same shape—that shape being driven by design constraints and previously designed bottling techniques.

Traditional approaches to illuminating the contents of beverage bottles have necessitated the design of either radically new bottle types, or have involved substantially modifying existing bottle designs. Given the large sums already invested by beverage manufacturers in traditional bottle designs and the associated plant and machinery, such an approach is not always commercially viable. Devices according to the present invention seek to overcome this problem i.e. they provide for contents illumination without the need to modify existing bottles.

SUMMARY OF THE INVENTION

Aspects of the present invention seek to overcome various problems which have been found to arise in the manufacture of light devices in accordance with international patent application WO 2004/110892.

According to a first aspect of the present invention, there is provided a self-contained illumination device for attachment to a container, comprising a pad of liquid-impervious material and with electrical elements of the illumination device attached to a central region of a major surface thereof, the central region being surrounded by an adhesive region of the major surface whereby the pad can be adhered to a container in liquid-tight manner.

An advantage of this arrangement is that, when a container having the device attached thereto is exposed to a wet environment, the electrical elements are kept dry. This means that they can continue working satisfactorily and, in the long term, are not degraded by electrolysis. In some embodiments of the invention the pad has a relatively thin slit therethrough from one major surface to the other major surface; in this case the slit is small enough that liquid does not pass through it.

In preferred embodiments the pad comprises a first layer to which the electrical elements are attached and a ring-shaped second layer covering and releasably attached to the adhesive region. Thus the second layer prevents the adhesive region from sticking to unwanted objects and is only removed when it is desired to attach the pad to a container or other article. The pad may be manufactured with separate parts of the second layer being adhered to and covering the central region of the first layer and the surrounding region of the first layer respectively. When manufacturing the device, the inner part of the second layer can be removed to allow the electrical elements to be adhered to the central region of the first layer.

A line of separation may extend across the second layer from the inner periphery of the ring to the outer periphery of the ring. This provides a convenient line along which to commence the peeling away of the second layer from the first layer, immediately prior to attaching the pad to a container.

The first layer preferably comprises recyclable and/or biodegradable plastics and/or paper material. This contributes to making the device environmentally-friendly; other components of the device are preferably biodegradable or recyclable.

The material of the first layer is preferably stronger than the material of the second layer. This is because the first layer lasts for the lifetime of the device where the second layer is only present until the pad is attached to a container.

The pad is preferably flexible, which contributes to precisely matching the contours of any container to which it is applied, thus readily providing liquid-tightness. Such a pad is also easy to handle, in the manner of a label. In addition it folds relatively easily over the edge of the electrical elements without cracking or creasing. Relatively stiff pads can be used, but there is an increased risk of liquid seepage. Also, stiffer pads tend to be thicker and thus do not have the advantage of compactness.

The electrical elements are preferably provided on or in a relatively rigid printed circuit board. This serves to avoid distortion of the electrical elements during the insertion of cells for the elements and during use of the device.

The thickness of the pad is preferably in the range 0.15 to 0.4 mm, more preferably 0.18 to 0.3 mm and most preferably substantially 0.21 mm. This provides a compact arrangement. In a preferred application, the device is attached to a recess in the base of a drinks container. Such a recess is typically deeper in its central region that at its edges, so the device's thickness there, where both the pad and the electrical elements are situated, is not particularly important. However, the edge region of the recess is relatively shallow and so the provision of a relatively thin pad ensures that it does not protrude beyond the bottom of the base of the container. Furthermore, a relatively large ring-shaped adhesive region can be provided.

The thickness of the second layer is in the range 0.05 to 0.15 mm preferably substantially 0.10 mm. The first and second layers are preferably attached to each other by a layer of adhesive having a thickness substantially in the region of 265 microns.

According to a second aspect of the present invention there is provided a method of manufacturing a self-contained illumination device suitable for attachment to a container, the method comprising:

- producing a pad having a first layer with a second layer releasably adhered thereto, the second layer having a first line of separation which separates an inner area thereof from a surrounding outer area, and a second line of separation which extends from said first line to the periphery of the pad,
- removing the inner area of the second layer and securing electrical elements of the illumination device to the thus revealed area of the first layer.

The first layer is preferably a layer of plastics material or paper. The second layer is preferably a layer of paper. When the pad comprises two layers of paper, they are preferably of different types; the first layer is preferably stronger than the second layer.

An advantage of the above method is that the inner area of paper can be removed when required during the manufacturing process and the outer layer of paper can be removed starting from said second line, when the device is subsequently to be applied to a container.

According to a third aspect of the present invention, there is provided a circuit in which at least first and second cells are mounted in a side-by-side configuration on a substrate by respective clips, each clip having a plurality of pins extending from spaced locations around the periphery thereof, wherein the pins on each clip are located remotely from the other clip. An advantage of the above placement of the pins is such that the respective clips cannot touch one another and thus cause a short in the circuit.

According to a fourth aspect of the present invention, there is provided a battery-operated device comprising a piece of insulating material, arranged in a position in which it prevents electrical contact of a battery with other circuit elements of the device, and being movable out of said position to permit such contact, wherein the direction of movement is such as to tend to move the battery in a direction towards a positioning element and/or electrical connection element for the battery.

An advantage of this arrangement is that removal of the piece of insulating material does not tend to loosen the battery nor its electrical connection, nor does it pull the cell from its position.

Another independent aspect of the present invention relates to the use of a rigid pcb within a flexible pad or label. This serves to avoid distortion of the pcb during insertion of the cells and during use.

Another independent aspect of the present invention relates to the use of unpackaged LED dies to save space.

Another independent aspect of the present invention relates to the use of air pockets within a pad or label to repel moisture which might enter through the slot through the pad or label for the pull tab. However only some of the embodiments of the present invention have a slot in the pad or label.

Another independent aspect of the present invention relates to a method of inserting cells manually into an open side of cell clips. This saves the use of large prefabricated plastic cell holders; it also provides flexibility regarding the time of insertion of the cells.

A further independent aspect of the present invention relates to using as a switch only the domed contact part of a tact switch. This saves space and height.

Devices in accordance with the present invention have their own power source and are mounted on a printable, self-adhesive label that is small enough to be stuck in the recess in the base of a glass or plastic bottle or container without the need to modify the bottle whatsoever. The device is small enough to allow the container to sit on a normal hard surface without tilting or wobbling. In other words the device should not protrude from the base of the container in any way. In particular the device is designed to fit in the base of a single serve bottle of 33 cl/12 oz volume (typically used for beer) which necessitates the device being very thin.

The shape, design and construction of the device is such that when it is stuck to the base of the container it forms a seal between the circuit and the bottle base such that an air pocket is formed. This prevents water/moisture ingress into the cavity protected by the air pocket and as such prevents the circuit from getting wet and malfunctioning. This is important because the typical operating environments for alcoholic based beverages are bars/clubs/parties/in the home where there is often a risk of the bottle base coming into contact with liquid/moisture e.g. in refrigerators, in ice buckets used to cool bottles or with spilt drinks on bar surfaces.

A switching arrangement for the device may include a single switch for one-off operation, or two switches, e.g. a first switch for connecting the battery cells to the rest of the circuitry, and a second switch, which may be a motion-sensitive switch, for connecting the LEDs or other lights into the circuit.

BRIEF DESCRIPTION OF THE DRAWINGS

Preferred embodiments of the present invention will now be described, by way of example only, with reference to the accompanying drawings, of which.

DETAILED DESCRIPTION OF PREFERRED VERSIONS OF THE INVENTION

Figure 1:
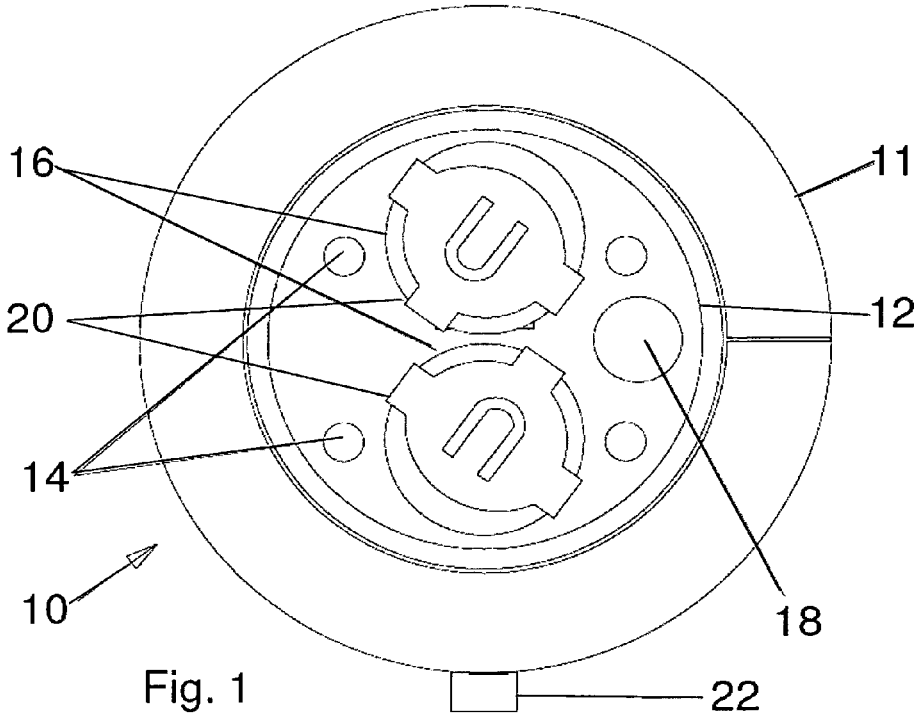
FIG. 1 is a top plan view of an illumination device attached to a label in accordance with a first embodiment of the present invention.
Figure 2:
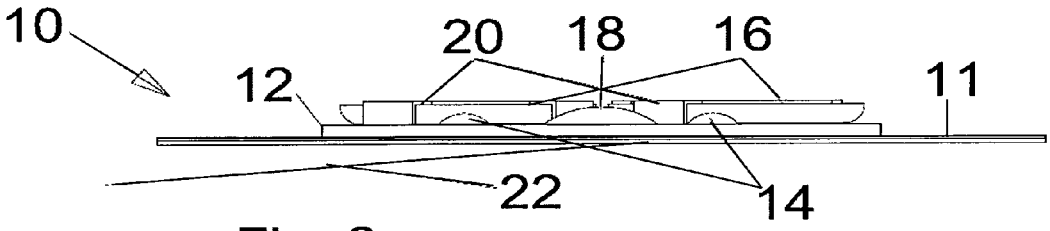
FIGS. 2 and 3 are side views of device of FIG. 1, taken in mutually perpendicular directions.
Figure 3:
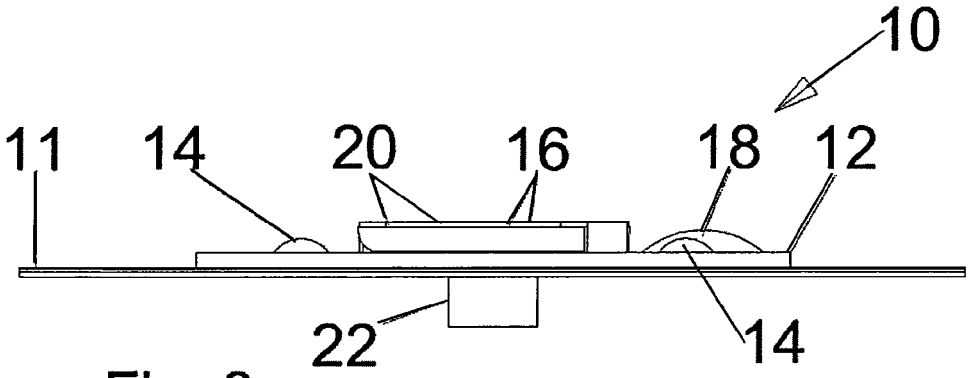
Figure 4:
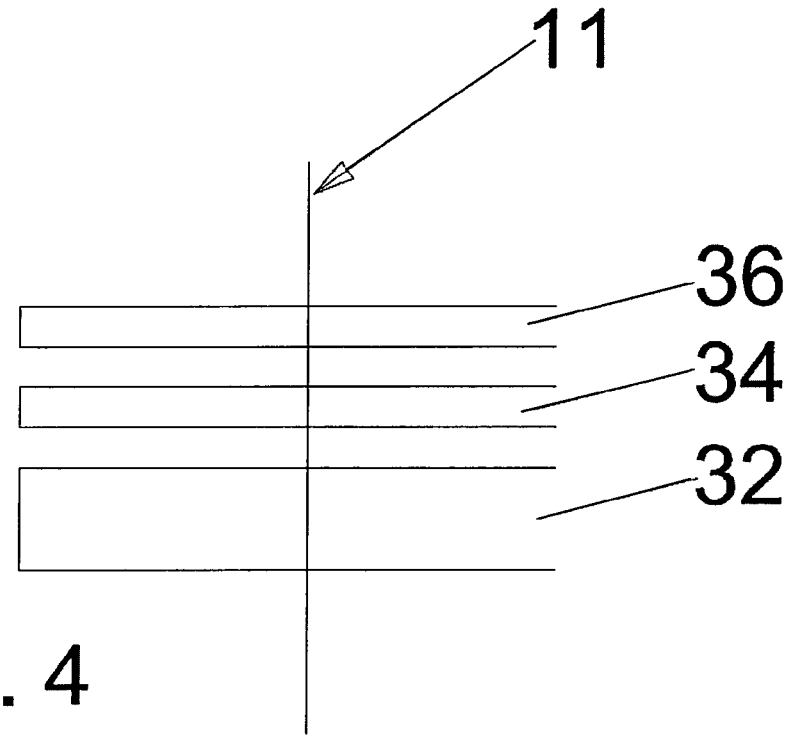
FIG. 4 is an exploded cross-sectional view of the material of a label for use in embodiments of the invention.
Figure 5:
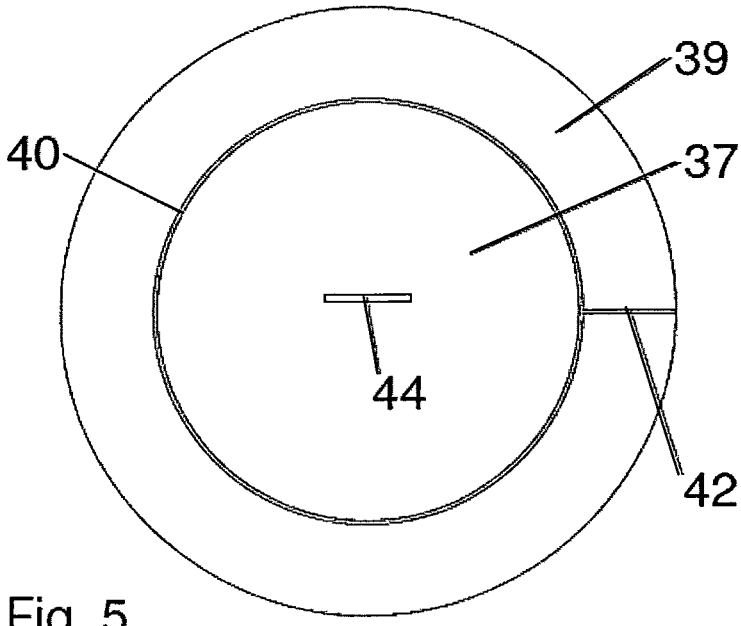
FIGS. 5 and 6 are views of the label respectively before and after an inner cover layer is removed.

Referring to the drawings a self-contained illumination device or light-pad 10, FIGS. 1 to 3, comprises a pad or label 11, to which is applied by adhesion a printed circuit board or pcb 12. The circuitry on pcb 12 comprises four LEDs 14 operated by two battery cells 16 and an integrated circuit package 18. The cells are attached to the pcb by cell clips 20. A pull tab 22 is provided to prevent the cells from delivering current until the tab is removed.

The pad 11 is made from three layers. The bottom layer 32 is of plasticised paper or flexible plastic material or alternatively it can be made from a strong paper. The middle layer 34 is glue. The top layer 36 is a removable paper.

If the bottom layer 32 is formed from plasticised paper material then it may be formed from a paper substrate material which is extrusion coated with a synthetic resin such as polyethylene.

If the bottom layer 32 is formed from a flexible plastic then the pad plastic is typically but not always formed from 0.18 mm to 0.21 mm thick, soft transparent PVC although the PVC need not necessarily be transparent.

The pad, be it made from PVC or plasticised paper, is designed to be flexible/malleable. This enables it to be attached to regular and irregular shaped areas, for example the base of glass or plastic bottles, without cracking or creasing. The base of a glass bottle is often smooth and regular, whereas the bases of plastic containers often have irregular shaped surfaces. The material composition allows the pad to fold over the edges of the pcb without cracking or creasing. Even at temperatures close to 0° C. the pad is soft enough to allow application of the device to a glass bottle. At higher ambient temperatures the pad is not too soft for application. The pads performance is not unduly affected by high levels of humidity. The pad is resistant to corrosive liquids such as some carbonated drinks. The pad material is impervious to all liquids within the environment for which it is designed. For example, alcoholic based drinks, carbonated drinks, high sugar content drinks, water, detergent, etc.

The physical size and shape of the pad can be altered to suit a specific application. Commonly, for a 33 cl glass bottle a circular pad with a diameter of 44 mm is suitable. Commonly, for a 75 cl glass bottle a circular pad with a diameter of 54 mm is suitable.

The underside surface of the plastic or paper layer is printable.

One glue which may be applied as glue layer 34 is 3M™ 9087 or similar. This is a modified acrylic adhesive type in the form of a high performance double coated tape with good resistance to plasticizer migration. Such plasticizers are typically found in PVC. Such products combine a very high level of adhesive peel and shear performance. The excellent initial tack ensures that a bond of good integrity is achieved soon after application. The adhesive is well suited to bonding together a wide variety of similar or dissimilar materials such as wood, metals, glass, powder coated finishes, paints, and many plastics and fabrics.

The glue 34 is applied to the PVC or paper layer 32 to form an adhesive sheet material. It provides a layer of a sticking agent on the surface of the substrate plastic sheet material or paper which can then be conveniently bonded on to the surface of glass or plastic bottles without the necessity of remoistening with water as in postage stamps.

Since bottles/containers may be made from glass, or PTE (poly tetra-ethylene), or HDPE (high density polyethylene) or other plastic such as PET, the glue must be able to cause a bond between the plastic layer of the pad and the material of the bottle/container.

The glue 34 is selected to be active (i.e. work/be suitably tacky) across a large temperature and humidity range. In other words in different parts of the world there are large differences in the ranges of temperatures and levels of humidity. The glue has been tested to work in these different conditions i.e. to stick to a bottle in Barbados or in Alaska. In addition its qualities allow a strong adherence to glass and plastics. This performs two functions; firstly it firmly holds the pcb to the pad to create a single device which can be attached to a bottle, and secondly once in position on such a bottle it creates a tight seal around the edges preventing the ingress of liquids or moisture into the area between the device and the recess of the bottle it is covering. The glue is also resistant to decomposition during the manufacturing process—this is important because the conditions where assembly occurs can be very hot and humid and the glue, if not of the correct type can degrade and lose its important qualities.

Ideally, the glue should begin to fail at a temperature above 80° C., and high humidity (hot water or hot steam). This means that the device may be removed from the product packaging as part of the recycling process, which may use hot water to remove paper and plastic labelling from product packaging. The overall device will therefore become detached and can be removed with the other paper and plastic labelling and handled accordingly. Alternatively the device may be peeled off by hand.

The glue does not create a permanent bond to human skin, thus allowing the device to be applied by hand. The glue bonds sufficiently to glass or plastic to thereafter remain bonded under further temperature changes, such as occurs during refrigeration. The glue is also resistant to immersion into water or iced water where such immersion may be momentary or may be for several hours. The adherence to glass or plastic is however not permanent and the device can be removed when required in order to separate materials for recycling purposes.

Experience has shown that a minimum surface area of the pad 11 needs to be covered with glue 34 in order for the device to adhere securely to a bottle base.

Commonly, for a 33 cl glass bottle an annular ring area of approximately 900-1000 $mm^2$ is suitable.

Commonly, for a 75 cl glass bottle an annular ring area of approximately 1200-1300 $mm^2$ is suitable.

The paper layer 36 is used to temporarily protect the sticky surface of the adhesive PVC sheet material so that it is protected from inadvertent sticking to an unintended surface. The peelable release paper is bonded to the sticky surface of the adhesive sheet material for temporary protection and the release paper is removed by peeling directly before use of the adhesive sheet material. The peelable release paper contains a releasing agent or anti-sticking agent to impart releasability to the surface of the peelable release paper. The releasing agents most widely used for the preparation of peelable release paper are those based on a silicone releasing agent by virtue of the outstandingly excellent performance in comparison with the releasing agents of the other types. However alternative releasing agents can also be used.

The release paper once bonded to the sticky surface does not spontaneously come off without an outer peeling force but can be readily removed by peeling with a relatively small peeling force when desired causing no decrease in the sticking power of the adhesive sheet material.

The paper layer 36 comprises an inner, circular area 37 and an outer, annular area 39 which is separated from inner area 37 by a cut line 40. The area 39 has a second cut line 42 extending radially or at an angle across it from the first line 40 to the periphery of the pad 11.

Figure 6:
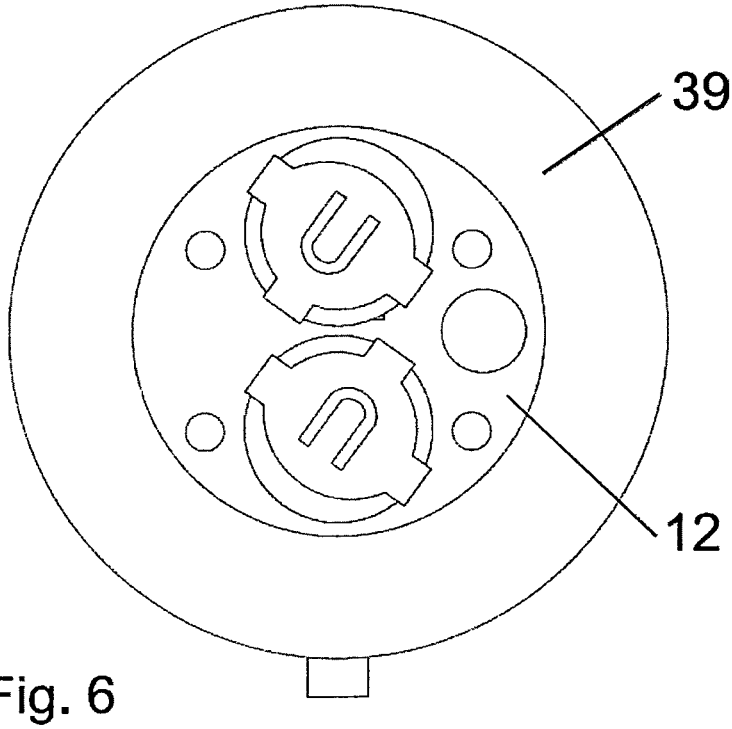

Before its removal by peeling it off, area 37 of the paper layer prevents the pad from sticking to any other object before assembly to the pcb. After it is stuck to the pcb (FIG. 6), the remaining paper 39 around the outer edge exists to prevent the pad from sticking to any other object before the device is applied to the product container.

The cuts 40, 42 in the paper are made to a depth that does not cut into the flexible plastic layer 32. Cutting into the glue layer 34 will not cause any harm to the pad, but cutting into the flexible plastic layer may cause it to split when the overall device is applied.

The paper 36 covering the glue should be strong enough to withstand being pulled from the glue area without ripping—such that it is removable in one complete piece and can be removed in a single motion. It also needs to have a slit cut into it so an edge can be easily found as a starting point for peeling the paper away from the pad.

The glue and paper are matched to function together in the manner described above. The first part of the paper to be removed is the central circular section 37. The paper is removed in order to expose a circular area of glue where the pcb is placed.

The pcb is placed centrally onto this area ensuring that any alignment is appropriately taken into account. The outer ring 39 of paper is removed at the time of attaching the device to a bottle.

Special punches have been designed which allow the overall shape of the pad 11 to be punched out and a central circular section in the paper and a small side cut in the paper, without cutting into the glue or PVC pad, and a small slot or slit 44 for a pull-tab 22 (when used) which is cut through all layers. Then the central area of paper 37 can be removed exposing a glued area where the pcb 12 can be placed. This allows and facilitates the construction of the device in stages, and thereafter aids the construction by hand as the glue face is protected until it is time to affix the pcb. The punches are made to a high tolerance.

Figure 7:
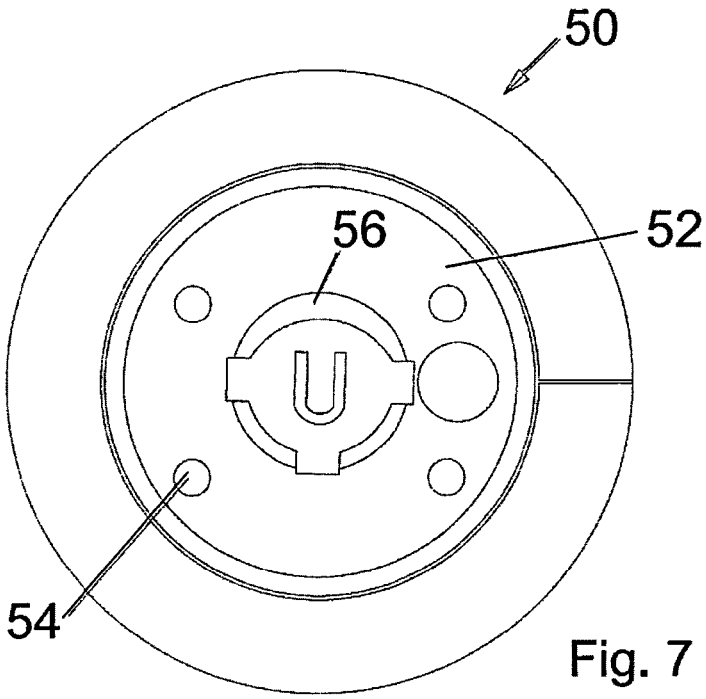
FIGS. 7 and 8 are respectively top plan and side views of a single cell embodiment of the present invention.
Figure 8:
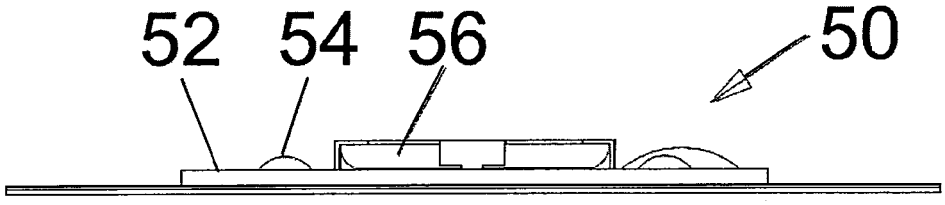

Two basic pcb specifications are shown in FIGS. 7 to 10. FIGS. 7 and 8 show a first version 50, which is designed to carry a single 3V cell, placed in the centre on the top surface of the pcb 52.

This device can therefore drive one or more LEDs 54 that generally do not require a forward voltage drop of greater than 2V. This currently includes red, green, yellow and orange LEDs.

Figure 9:
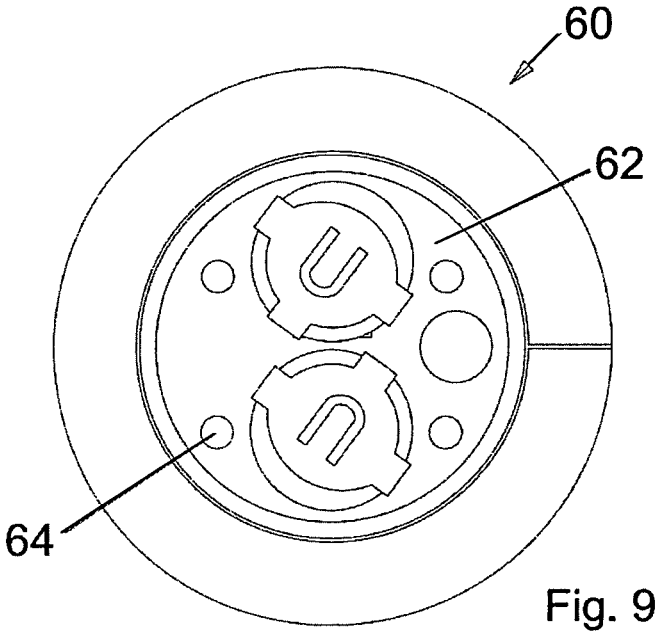
FIGS. 9 and 10 are respectively top plan and side view of a two cell embodiment of the present invention.
Figure 10:
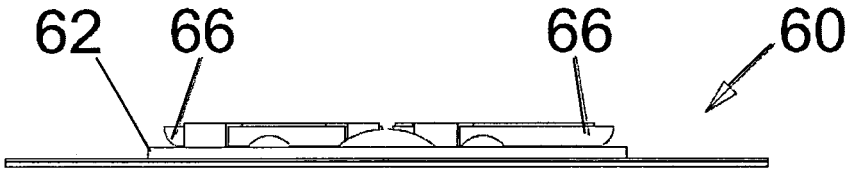
Figure 11:
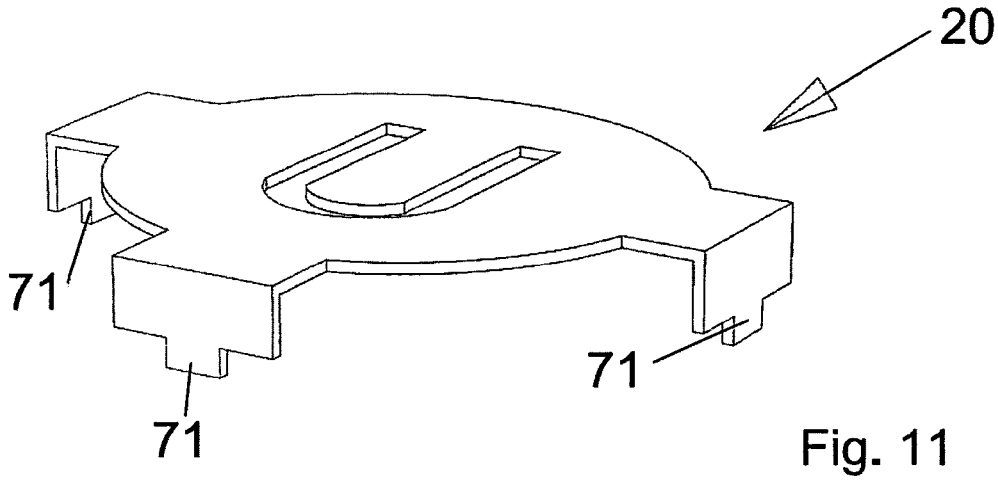
FIG. 11 is a perspective view of a cell clip for use in embodiments of the present invention.

FIGS. 9 and 10 show a second version 60, which is designed to carry two 3V cells 66, again placed on the top surface of the pcb 62. Version 2 can therefore drive one or more LEDs 64 that require a forward voltage drop of greater than 3V. This currently includes blue, white, ultra violet and jade green LEDs.

The pcbs, in both cases, are circular although they could be another shape e.g. square in order to fit a specific shape of bottle design.

The thickness of the pcb can range from 0.4 mm to 1.6 mm. The pcb is appropriately as thin as possible as there is little height space available under a common 33 cl bottle, for example. A rigid substrate pcb is used to ensure that the insertion of the cell(s) during assembly does not cause any significant warpage of the pcb, as this in itself can cause the pcb cell contact area, on the pcb surface, to be curved away from the cell and thus not make contact with the cell connection. The maximum area available on the pcb surface for connection to the cell is used in order to prevent disconnection occurring. The diameter around the cell contact area where there is no solder mask is larger than the diameter of the cell contact itself. This clearance around the cell contact area ensures that the cell is not lifted away from the contact area by the edges of the solder mask.

The most common shape for the pcb is a circle, as most bottles are designed with a circular base. However the pcb shape is not limited to a circle.

Commonly, for a 33 cl glass bottle a pcb diameter of 25-30 mm is suitable.

Commonly, for a 75 cl glass bottle a pcb diameter of 35-40 mm is suitable.

Devices in accordance with embodiments of the present invention use the direct application of LEDs 14, 54, 64, in un-packaged die form, to the pcb tracking. Although pre-packaged LEDs could be employed, this is generally a more costly approach and they are often bulkier so making them unsuitable for the small area under a bottle.

The LED dies are bonded directly to the pcb 12, 52, 62 and protected by a quick-drying liquid resin. The application of this resin is carefully specified during assembly to ensure the resin is poured directly over the centre of the LED so the LED ends up positioned at the centre of the resin. This controls the optics of the resin/LED combination to ensure that the light output is perpendicular to the pcb plane. Deliberate displacement or offsetting of the resin can be used to alter the output angle of the light, if required. The amount of resin poured on is also controlled to limit the overall height of each resin dome. This is important as the resin/LED combinations are generally positioned near the outer edges of the pcb and must not be so high as to prevent the device correctly fitting into the small space under a bottle. This is because the height available near the edges of the pcb is less than the height available near the centre of the pcb because the underside of a bottle is generally dome shaped.

The type and wavelength of the LEDs are chosen depending on the colour of the container and the colour of the contents to be illuminated. They are also chosen depending on the colours required for the promotion by the client. More than one colour may be employed.

The device can employ one or more LEDs.

High intensity LEDs are generally used to overcome light absorption by coloured bottles and/or semi-opaque bottle contents.

Typically an application on a 33 cl beer bottle would use 3 or 4 LEDs. An application on a 75 cl bottle would typically use between 4 and 6 LEDs.

It is preferred that clear resin over the LEDs is used. Where a pre-packaged LED is used, such as surface mounted LEDs or even larger pre-packaged LEDs, it is preferred that these have clear resin, so that the colour of the emitted light cannot easily be determined until after activation has occurred. This is particularly relevant where this system is employed for a promotional competition (for example, a limited number of "winning" containers may emit a different colour to regular containers).

The circuitry of the integrated circuit package 18 is selected or a bespoke circuit is designed according to the specific requirements of the client. Typically a client wants a circuit that will make the illumination permanently on until the cells are exhausted or flash or fade the LEDs in some way. The design also takes into account the length of time the illumination is to last for. Typically for a device for a beer bottle this would be greater than 30 minutes but less than one hour. For applications on larger sized spirits bottles the devices can be designed to last for hours, days or weeks depending on the clients requirements.

Where possible, mass manufactured ICs are employed in order to keep the cost low. Also the ICs are generally in die form and are bonded directly to the pcb tracking. Thereafter the ICs are covered in a protective resin. The amount of resin is also controlled during manufacture to ensure the height of this resin does not exceed the height limitations.

The cell clips 20 are commonly plated copper, but can be made from plated steel or other conducting material.

Figure 12:
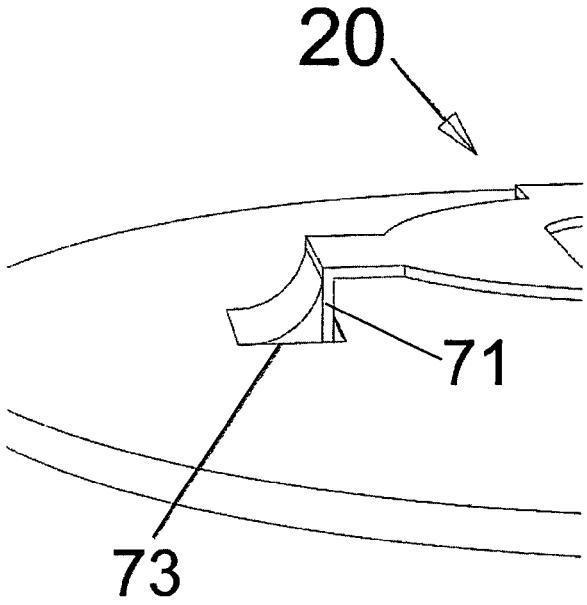
FIGS. 12 and 13 are detailed view of part of the clip of FIG. 11.

The cells require two connections to them. One connection is made by direct contact to the pcb tracking; the other connection is made by means of a respective cell clip 20. The clip also has the function of retaining the cell in the correct position for continued operation. Cell holders, which would otherwise be required, can be large and bulky and costly. The device uses clips formed from pressed sheet metal instead of cell holders. These cell clips have pins 71, which are placed into locating holes in the pcb, and large flatted areas either side of the pins to aid in manually positioning the clips parallel to the pcb. The clips are soldered or crimped into place. With the use of manual assembly, the ease of placement and positioning of the cell clip(s) is important. The amount of solder used here is also carefully controlled to ensure that there is no excess of solder around the clip or above the natural height of the clip. When the solder 73 is applied it can be allowed to flow across the whole width of the clip pin, see FIG. 12. FIG. 12 shows that the solder can naturally flow on the outside and the inside of the clip pin. However the amount of solder on the inside of the clip pin must be carefully controlled in order to not have excessive amounts of solder that may make contact with the other cell connection.

Having the clips located to specific points with pins, as opposed to being manually placed surface mounted clips, reduces the risk of the clips being misplaced and hence potentially shorting to another clip. Experience has shown that poorly fitted cell clips are a primary cause of intermittent operation. In addition the cleanliness of the clips is important to ensure good quality connections.

Figure 13:
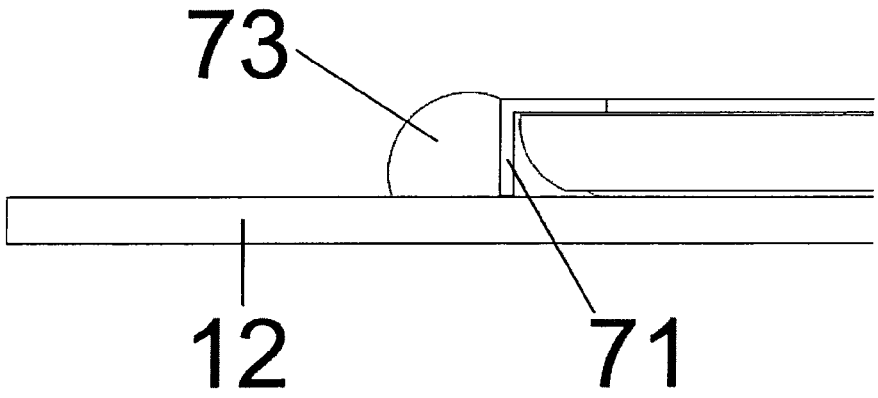

The solder should not be allowed to build up and grow above the height of the cell clip, as shown in FIG. 13, since the overall height of the device must be well controlled.

Figure 14:
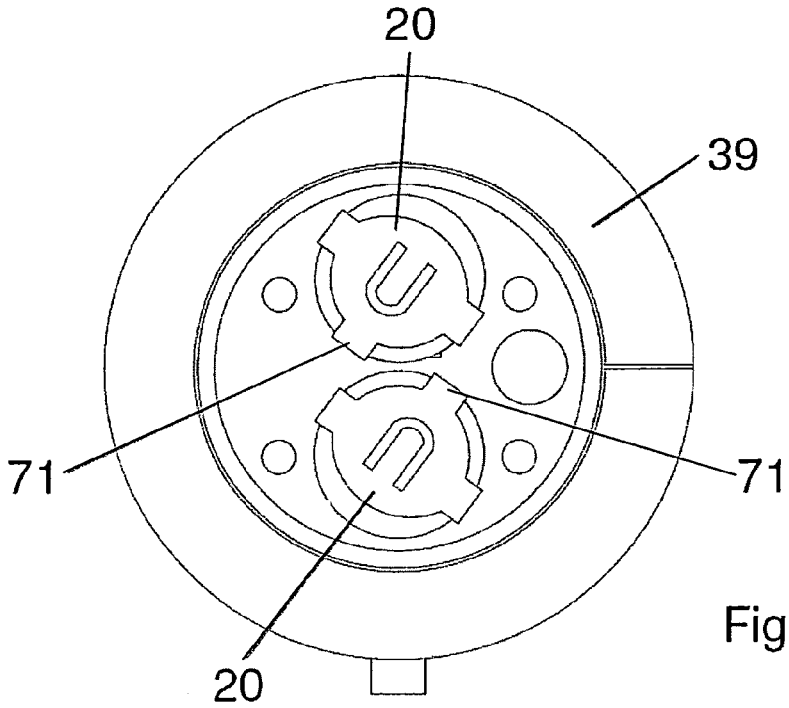
FIG. 14 is a top plan view of a two cell embodiment of the present invention.

The basic clip 20 has three pins 71, the third pin also being the end stop. When two clips 20 are used, as in the second version shown in FIGS. 9 and 10, it may not possible to have both of the end stop pins soldered to the board with these pins located very close to each other. Where two cells 16, 56, 66 and hence two clips 20 are employed, the clips can be either set so they are facing and hence parallel but opposite to each other, or they can be set so they are rotated away from each other in opposite directions (FIG. 14), or they can be rotated in the same direction.

Since the clips 20 are very close to each other, rotating them can eliminate the possibility of the opposite clips or cells making accidental contact with each other. The reason the clips must be as close to one another as possible is to keep the diameter of the pcb as small as possible as the domed area under a bottle is very small—if the clips were spaced further apart the device would not fit properly under the bottle and the bottle could not be placed down flat on a surface (i.e. the bottle could wobble). Having the clips positioned close to one another also allows for the maximum possible surface area of glue on the PVC label to be employed in area 39 so that the device can be securely stuck to the bottle base. Cell clips are not always required as it is possible to use cells that have pins which can be soldered directly into the circuit.

The cells 16, 56, 66 are chosen to match the size constraints that the device has to operate within (in other words the cells need to be extremely thin so as to allow the device to fit into the narrow recess in a bottle base) and also the current and voltage requirements for the circuit. For example, standard red, green and yellow LEDs can be driven using a source of 3V or less whereas it is necessary to have a voltage greater than 3V to successfully drive blue, white, UV, jade green LEDs etc. Typically the device uses lithium cells that provide 3V necessitating two cells to drive devices utilising for example blue, white, UV, jade green LEDs whereas only one cell is required to drive devices using for example standard red, green and yellow LEDs. However experience has shown that in many applications where technically only one 3V lithium cell is required (e.g. to drive a standard red LED) it is in fact better to use two lithium outputting 6V to increase the light output significantly thereby creating a better illuminating effect for the container contents. Using 6V when only 3V is required is not normal practice as the LEDs may have their life prematurely reduced, but in this application longevity of the LED is not a constraint as the devices used on say a beer bottle, only need to last less than an hour. In practice using the LEDs in this fashion has not increased any LED failures to any significant degree, but has provided the advantage of a greater light output.

The cell or cells have a natural current limit to them and so it is also often not necessary to employ current limiting techniques. In common use within the devices, the CR1212 is employed because of its shallow height and small diameter. Larger cells can be employed for larger devices under larger bottles—typically on motion sensitive devices for large size spirits/liquor bottles the cells used are CR1616.

The cells are required to be cleaned and be free of any oxidants or contaminants on their surfaces; this is to further ensure that good quality connections are made.

It is also possible to sink or bury the cells into holes or spaces in the pcb, or at the edge of the pcb. This can be achieved by creating one connection for the cell within the inner wall of the pcb hole, for example, and the other connection to the cell with a pressured contact, bonded wire, etc. The pcb wall connection may be plated, as with the process of through-hole plating in the manufacture of the pcb, or may have an additional contact placed over the pcb edge to connect to the cell. This approach further reduces the overall height of the device. It also eliminates the requirement for the cell clips as covered earlier.

For the material of pull-tab 22, PVC is commonly used. The purpose of a pull-tab is to insulate and disconnect the power source 16, 56, 66 from the circuitry to prevent any power drain or activation occurring prior to intended use. The pull-tab ideally should be less than 0.05 mm thick.

The pull-tab can be removed from the side of the device that is not stuck down to the bottle base through a slit that is cut through the pad and the pcb that the pull-tab passes through. The advantage of this approach is that the device 10 can be stuck to the bottle and then at a later time the tab 22 can be removed to activate the device. So for the purposes of a large scale promotion, thousands of bottles (for example) can have devices stuck to them at a bottling plant or warehouse, the bottles can then be transported to multiple locations and stored, and some time in the future when the promotion begins, the tab can be removed to activate the device.

Alternatively if the device does not have a slit cut through the pad and the PCB, the pull tab may be removed from directly under the cell prior to the device being stuck down to the bottle.

In both instances the physical position of the pull-tab under the cell is relevant to enable correct operation. The device cell clips 71 (which hold the cells onto the pcb and provide connections) have a butt/stop on one side, but are open ended on the other side. The reason for having one side that is open ended is to facilitate the insertion of the cells by hand into the cell clip during manufacture. Ordinarily a pull tab would be placed under a cell and be protruding from its outermost edge. This would not work well in this instance as it would tend to pull out the cell from the cell clip because the outermost edge of the cell clip is open. In the case of this application therefore, the pull tab is positioned so it pulls the cell into the centre of the device and thus into the butt/stop of the cell clip. So the pull tab either passes up from the underside of the pad through a slit in the pad, then through a slit in the pcb, then over the pcb edge to its position under the cell, or if there is no appropriate slit, it is positioned directly under the cell such that its removal pulls the cell more firmly against the butt/stop of the cell clip.

Figure 15:
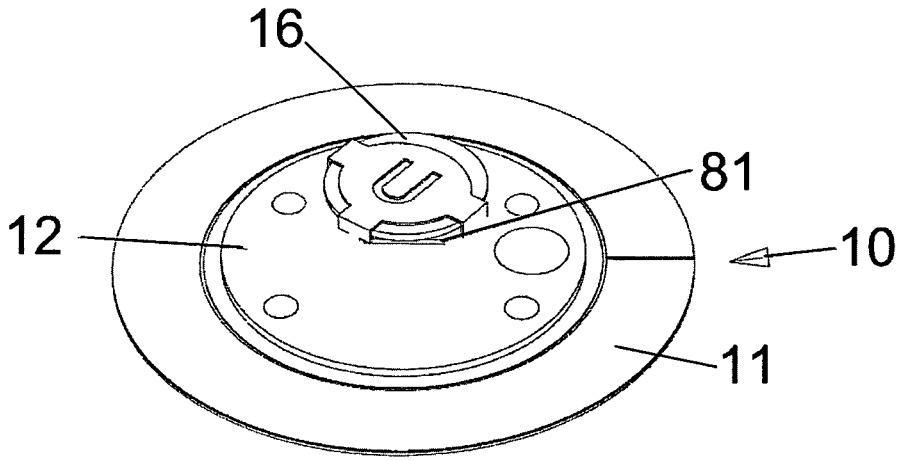
FIG. 15 is a top plan view of an embodiment of the present invention which employs a pull-tab switch.

The slit in the pcb for the pull-tab to pass through can be about 0.5 mm wide and 7 mm long. FIG. 15 shows the slit or slot 81 in the pcb 12 through which the pull-tab is passed. The pull-tab passes through the pcb from underneath and is placed between the cell and the pcb. In FIG. 15, the cell 16 on the left has the pull-tab beneath it.

In some versions of the device, the pull tab acts as a single activation step i.e. once removed the device activates. In other instances the pull tab forms part of a two stage (or other multiple-stage) activation step. An example of a 2 stage application step would be the activation of the motion sensitive device. Here, the pull tab once removed allows the motion sensitive switch to act as the actual trigger. Prior to the pull tab being removed the motion sensitive switch cannot activate.

The material of the pull-tab is chosen to be an insulating plastic of 0.05 mm thickness or less. The material does not stretch, when the tab is pulled. The thickness of the tab is also important to ensure that during its life under a cell it does not cause the cell clip to be deformed, which may otherwise result in the clip becoming loose around the cell after the pull-tab has been removed.

The pull-tab can be manufactured to a customer specified length and can be of a customer specified colour to match any design tailoring requirements. It may also be printed on.

Figure 16:
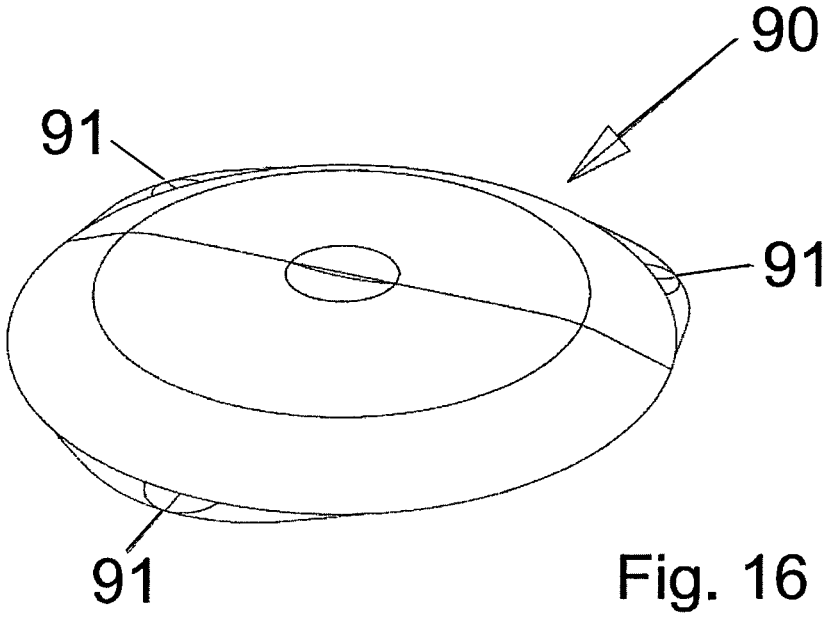
FIG. 16 is a top plan view of an embodiment of the present invention which employs a tact switch.

An alternative (or as one stage of a two stage method) of activation to the pull-tab 22 is the use of a tact switch arrangement as shown in FIG. 16. The overall height of the switch is about 0.2 to 0.4 mm, but still allows a positive action feel. A complete housed commercial tact switch is too bulky for this application, thus only the domed contact part 90 is employed. An additional advantage to using only the domed contact element is the reduced cost. This domed contact is positioned onto the pcb 12 directly. When the dome is pressed it connects tracks on the pcb at its outer edge to a pcb track under its centre. Thus a switch is completed.

This domed contact can be attached to the pcb by adhesive tape which is a very low cost method, or by soldering or other method. Experience has shown that designing the domed contact element with pins so that it is through-hole mounted allows the switch to be placed quickly and accurately by hand into the correct position on the pcb. Alternatively the domed contact element may be surface mounted rather than through-hole mounted. Contact points 91 for the arrangement are shown. The domed contact element is preferably of stainless steel.

Whereas the standard shape of the device is circular, it is not restricted to this exact shape. However, in practice is it simpler to manufacture using a circular pcb and this provides a larger pcb area for tracking and LED placement than a smaller oval or elliptical shape. Positioning the LEDs on the pcb nearer to the outer limits of the pcb has often proved to provide better visual impact of the illumination. If the pcb were not circular, but was still being used on a circular bottle, the LED placements may not be ideal. In addition, providing a circular device for placement onto a circular bottle base allows the user to more readily position the device in its optimum position. With a circular adhesive pad providing the best adherence and visual positioning on a circular bottle it follows also that a circular pcb is also most suitable. Furthermore when placing the device in position, it becomes a natural motion to press the outer edge of the pad, where the glue is exposed because the thumb and forefinger can feel the edge of the pcb as pressure is applied in a circular motion.

The overall shape of the device has been specifically designed to ensure that no modifications to the container it is fitted to are required, making the device suitable for use on any standard container be it fabricated from glass, plastic or metal or other types of material. This means that the device can be applied after manufacture of the bottle and does not have to be an integral part of the bottle manufacturing or bottle filling process.

Furthermore the combination of pcb and an adhesive pad in a circular shape results in a device, which can be easily glued to a curved glass or plastic or metal area. Once the device has been glued in place it is sealed around its outer edges from the ingress of moisture from the surrounding environment. This is important for applications on for example, beer bottles, where it is commonplace to fully immerse the bottle into iced water. The slit for the pull-tab (if used) is a very small area and does not allow further ingress of moisture because of the contained air pocket between the device and the container. Using an overall encapsulation, for example encasing it in a moulded plastic, to seal the device substantially from the environment, although possible, would still lead to difficulties in activation (as it would still be necessary to have at least one hole for a pull-tab for example) and even greater difficulties in containing the whole device (including an encapsulation) within the restricted area of the small curve under a 33 cl bottle.

The device can be manufactured to comply with the recycling and restricted substances specifications of different countries.

The fact that the device can be retrospectively fitted to standard containers makes it highly commercially viable as a contents illumination tool.

Previous attempts by other companies to solve the contents illumination problem have all necessitated the manufacture of specialised containers or modification to existing containers or have required the illumination device to be physically built-in to the container itself (i.e. an integral part of the container). Given the large sums of money already invested by beverage companies in building plant and machinery to produce their existing container types, having to modify the container or redesign the container would be expensive and impractical.

Devices in accordance with embodiments of the present invention may be designed to be used until their cell power is exhausted and be thereafter disposable. So for example on a beer bottle application the devices are designed to last for approximately one hour. A motion sensitive device for a larger sized spirit bottle is designed to last for several days or longer. However the devices could be reused by renewing the cells and if necessary applying a fresh pad.

The activation method commonly involves the closing of a circuit. This may be the closing of one or more circuit parts. For example, using the removal of a pull-tab as the only activation method may be implemented by allowing a cell contact to connect to the circuit as the pull-tab is removed. In the case of a two-stage activation, the removal of a pull-tab to allow connection of the power source to the circuit is preferred as the first stage, and thereafter a standard circuit trigger input can be triggered by the use of different sensors, with or without an interface circuit to such a trigger input. Such sensors may include motion sensors such as inertial switches, vibration sensors such as piezo elements, temperature sensors such as PTCs, NTCs or infrared detectors, magnetic sensors such as hall-effect devices, light sensors for detecting changes in ambient light levels, wireless sensors such as radio frequency receivers, electromagnetic sensors such as LDRs or photo-diodes, sound sensors such as electret condenser microphones such that the light emission may be synchronised with music, moisture sensors, proximity sensors, pressure sensors, manual switching, direct circuit interfacing, etc. If a sensor is available or becomes available, which is of a suitable physical size then implementation into the device becomes possible.

For certain of these activating methods, it is advantageous to have an initial activating event (for example, removal of a pull-tab), with a secondary activating event, for example, the bottle reaching a suitable temperature for consumption. This would prevent unintended activation, say, during transit or storage of the product.

The illumination effect can be made time variable so the effect lasts for or starts after a specified period of time or after specified conditions have occurred.

It is possible to implement each and any sensor, or more than one type of sensor simultaneously.

The device may be applied to articles other than containers. For example it can be applied to a substrate to form a self-contained badge capable of illumination.

The invention claimed is:

1. A self-contained illumination device for attachment to a container, the device comprising:

a. a pad formed of a first layer and a second layer wherein:

(1) the first layer:

(a) is formed of a liquid-impervious material, (b) is flexible and at least partially foldable, (c) has first and second opposing major surfaces wherein:

i. a thickness between the first and second major surfaces is in the range of 0.15 to 0.4 mm, ii. the first major surface has a central region surrounded by an adhesive region, and iii. the second major surface of the pad is printable;

(2) the second layer covers and releasably attaches to the adhesive region of the first major surface of the first layer, b. illumination device electrical elements provided on a rigid circuit board, the circuit board being attached to the central region of the first major surface of the first layer, whereby upon removal of the second layer from the adhesive region of the first layer, the adhesive region can be adhered to, and can adopt the contour of, a surface of a container in liquid-tight manner, with the circuit board situated between the container and the central region of the first layer.

2. A device according to claim 1, wherein the second layer is ring-shaped.

3. A device according to claim 2, wherein a line of separation extends across the second layer from the inner periphery of the ring to the outer periphery of the ring.

4. A device according to claim 2, wherein the first layer comprises biodegradable plastics and/or paper material.

5. A device according to a claim 2, wherein the material of the first layer is stronger than the material of the second layer.

6. A device according to claim 1, wherein the adhesive region comprises a glue, wherein failure of the glue occurs at a temperature of above 80° C. with high humidity.

7. A device according to claim 1, wherein the electrical elements comprise one or more light sources and one or more battery cells.

8. A device according to claim 7 wherein the or each light source is an LED.

9. A device according to claim 7 wherein cell clips for the or each battery cell are also provided on the circuit board.

10. A device according to claim 7, wherein the or each battery cell is in electrical communication with the other electrical elements by a pin.

11. A device according to claim 1, comprising a piece of insulating material arranged in a position in which it prevents electrical contact of a battery cell with other circuit elements of the device and being moveable out of the position via a slot through the circuit board and/or a slit through the pad.

12. A device according to claim 1, wherein the electrical elements include a switch defined by a depressible domed contact, wherein the domed contact lacks any rigid cover thereover, whereby a depressing force can be applied to the domed contact without being transmitted through any rigid cover to the domed contact.

13. A method of manufacturing a self-contained illumination device comprising electrical elements and being suitable for attachment to a container, the method comprising the steps of:

producing a pad having a first layer with a second layer releasably adhered thereto, the second layer having a first line of separation which separates an inner area thereof from a surrounding outer area, and a second line of separation which extends from the first line to the periphery of the pad, removing the inner area of the second layer to reveal an area of the first layer, and securing to the thus revealed area of the first layer a rigid circuit board with the electrical elements of the illumination device secured thereto.

14. A method of attaching a self-contained illumination device to a transparent wall of a container comprising the steps of:

providing a pad having a first layer and a second layer releasably adhered to the first layer, the second layer comprising an inner area surrounded by an outer area, removing the inner area of the second layer to reveal an underlying inner area of the first layer, securing to the inner area of the first layer a rigid circuit board with electrical elements of the illumination device mounted thereon, removing the outer area of the second layer to reveal an adhesive region of the first layer surrounding the circuit board, and adhering the surrounding adhesive region to the transparent wall in liquid-tight manner, whereby the illumination device is capable of illuminating the contents of the container.

15. A method according to claim 14 wherein, when the surrounding adhesive region is being adhered to the transparent wall, an air pocket is formed between the inner area of the first layer and the adjacent region of the transparent wall.

16. A method according to claim 14, wherein the outer area of the second layer is in the form of a ring and a line separation extends across the second layer from the inner periphery of the ring to the outer periphery of the ring, and wherein the step of removing the outer area of the second layer is started from the line of separation.

17. A self-contained illumination device for attachment to a container, wherein the illumination device includes:

a. a flexible and at least partially foldable pad having:

(1) opposing major surfaces, wherein one of the major surfaces has a central region and an adhesive region surrounding the central region, and (2) an intermediate thickness between the opposing major surfaces, b. a circuit:

(1) attached to the central region of the pad, and (2) bearing electrical elements including a light source and a battery, c. a releasable layer releasably adhered to at least the adhesive region of the pad, wherein the circuit and pad together have a major diameter which is at least 22 times greater than their combined thickness, whereby the releasable layer can be removed from the adhesive region, and the adhesive region of the illumination device can be adhered to a surface of a container with the pad at least substantially conforming to the surface, and with the circuit situated between the pad and the container.

18. The method of claim 13 wherein the first and second layers are flexible and at least partially foldable.

19. The method of claim 14 wherein the first and second layers are flexible and at least partially foldable.

* * * * *